United States Patent [19]

Stepanek et al.

[11] Patent Number: 4,693,489

[45] Date of Patent: Sep. 15, 1987

[54] HEELPIECE FOR SAFETY SKI BINDING

[75] Inventors: Premek Stepanek, Garmisch-Partenkirchen; Ludwig Wagner, Farchant; Walter Knabel, Murnau, all of Fed. Rep. of Germany

[73] Assignee: Marker International Company, Salt Lake City, Utah

[21] Appl. No.: 703,270

[22] Filed: Feb. 20, 1985

[30] Foreign Application Priority Data

Jun. 23, 1983 [DE] Fed. Rep. of Germany ..... 3322634

[51] Int. Cl.[4] ..... A63C 9/08

[52] U.S. Cl. ..... 280/634; 280/628

[58] Field of Search ..... 280/632, 631, 634, 628, 280/626

[56] References Cited

U.S. PATENT DOCUMENTS

| | | | |
|---|---|---|---|
| 3,317,217 | 5/1967 | Poiger | 280/632 |
| 3,734,520 | 5/1973 | Hashioka | 280/632 |
| 3,933,363 | 1/1976 | Schweizer et al. | 280/632 |
| 4,384,733 | 5/1983 | Krob et al. | 280/632 |
| 4,421,341 | 12/1983 | Krob et al. | 280/628 |

FOREIGN PATENT DOCUMENTS

| | | | |
|---|---|---|---|
| 1478215 | 6/1970 | Fed. Rep. of Germany | 280/632 |
| 2224079 | 12/1972 | Fed. Rep. of Germany | 280/631 |
| 2340420 | 2/1975 | Fed. Rep. of Germany | 280/632 |
| 2517391 | 11/1975 | Fed. Rep. of Germany | 280/634 |
| 2456326 | 8/1976 | Fed. Rep. of Germany | 280/631 |
| 1537980 | 1/1969 | France | 280/632 |
| 2007351 | 3/1969 | France | 280/632 |
| 2093547 | 1/1972 | France | 280/632 |
| 2116767 | 7/1972 | France | 280/632 |
| 2470619 | 6/1981 | France | 280/632 |

*Primary Examiner*—John J. Love
*Assistant Examiner*—Eric D. Culbreth
*Attorney, Agent, or Firm*—D. Peter Hochberg

[57] ABSTRACT

A heel piece for a safety ski binding is provided comprising a support member in the form of a slide member on which is pivotally mounted a sole holder having a pedal, a sole engaging portion and an interior cam surface configured to cooperate with a bearing member or cam follower which engages the cam surface. The cam follower is supported by a bearing lever having an axis of rotation near the upper surface of the ski, and a connecting member. The cam surface has an upper portion, a lower portion and an intermediate critical portion, and the binding opens when the soleholder is driven upwardly so that the critical portion passes the cam follower. An opening lever for manually opening the binding is rotatably attached to the connecting member, and is pivotally mounted on the soleholder. A spring disposed between the axes of the opening lever and of the bearing lever biases the connecting member to urge the soleholder to a closed position when the cam follower is in the upper cam portion, and to an open position when the cam follower is in the lower cam portion.

7 Claims, 8 Drawing Figures

HEELPIECE FOR SAFETY SKI BINDING

This invention relates to safety ski bindings, and in particular to heel pieces for safety ski bindings.

Safety ski bindings are provided for retaining a skier's boot on a ski, and for releasing the boot from the ski when forces which could cause injury to the skier are detected. Many types of bindings have been proposed and marketed over the years, and various bindings have performed well for their intended purposes. However, there has been a continuing quest to develop a safety ski binding which not only performs its boot retaining and release functions, but further is economical to manufacture. Known bindings are generally characterized by complex mechanisms such as a variety of linkages. These bindings are necessarily expensive to construct because of the costs of manufacturing the binding components, and because of the labor required to assemble those components.

The economy of manufacturing such bindings becomes even more important as skiers demand features besides those of retaining and releasing a ski boot in and from a ski. Such added features include means for manually and easily opening the binding such as at the end of a ski run, automatic compensation for various ski boot sole thicknesses, easy adjustment for various boot lengths, and means for enabling limited binding movement without release. Prior ski bindings, which provide for these added features have resulted in greater complexity of the binding and an increase in the number of parts, all adding to the cost of the binding. Thus, for example, German Patent Application Nos. B-1,478,215 and A-24 08 159 include a manually operable opening lever, but they require a special spring for opening the sole engaging member of the binding in response to actuation of the opening lever. German Patent Applic-tion No. B-1,478,215 has the further disadvantage of having the axle of the sole engaging member disposed very close to the upper surface of the ski, making it necessary to adjust the sole engaging member according to the thickness of the particular binding used. German Patent Application No. B-24 08 159 provides for automatic adjustment of the sole engaging member according to the thickness of the boot sole, but a spring is needed to produce a locating bias on the sole engaging member, a special mount for the spring is required, and an assembly for the adjustment of this spring is also employed.

SUMMARY OF THE INVENTION

It is an object of the invention to provide an improved heel piece for a safety ski binding which is strong and reliable.

Another object is to provide an improved heel piece for a safety ski binding which has few parts yet is effective in use.

A further object of the invention is to provide a ski binding having an effective manual opening lever which does not require a special opening spring for opening the binding.

Still an additional object is the provision of a binding which automatically compensates for boot soles of varying thicknesses which does not require a special spring for the sole engaging member of the binding.

Yet another object of the invention is the provision of a compact heel piece for a safety ski binding which is economical to manufacture and efficient in use.

Another object is the provision of a rugged and economical ski binding heel piece which has a long useful life.

Other objects will be apparent from the description to follow and from the appended claims.

The foregoing objects are achieved according to the preferred embodiments of the invention by the provision of a heel piece for a safety ski binding comprising a support member in the form of a slide member on which is pivotally mounted a sole holder having a pedal, a sole engaging portion and an interior cam surface configured to cooperate with a bearing member or cam follower which engages the cam surface. The cam follower is supported by a bearing lever having an axis of rotation near the upper surface of the ski, and a connecting member. The cam surface has an upper portion, a lower portion and an intermediate critical portion, and the binding opens when the soleholder is driven upwardly so that the critical portion passes the cam follower. An opening lever for manually opening the binding is rotatably attached to the connecting member, and is pivotally mounted on the soleholder. A spring disposed between the axes of the opening lever and of the bearing lever biases the connecting member to urge the soleholder to a closed position when the cam follower is in the upper cam portion, and to an open position when the cam follower is in the lower cam portion.

The heel units according to the invention each form part of a safety binding for a ski, in which binding the front of a ski boot is held in the usual way by a toe unit mounted on the ski. Such a toe unit serves to release the ski boot at least in response to excessive sideways loading.

Figure 1:
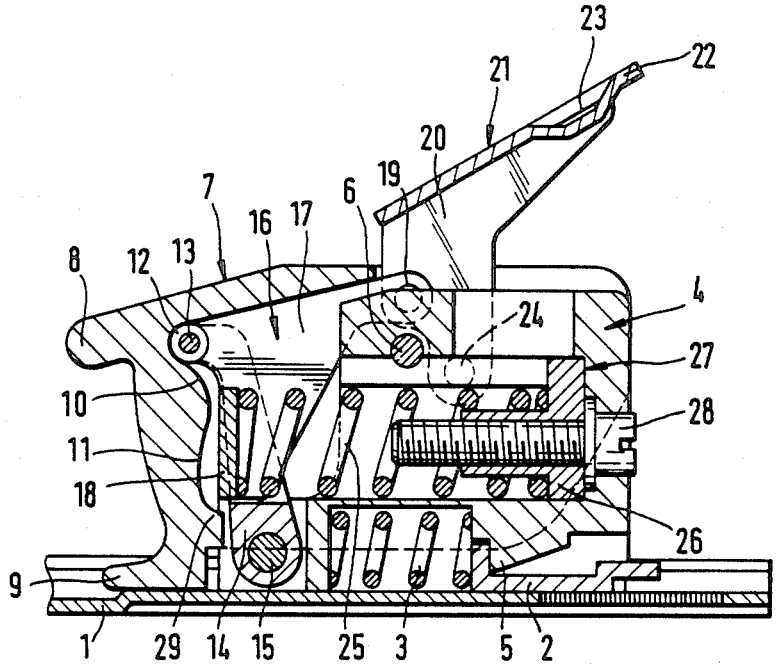
FIG. 1 shows in cross-sectional side view of first embodiment of a heel unit in accordance with the invention in a condition it exhibits when the ski is in use.
Figure 2:
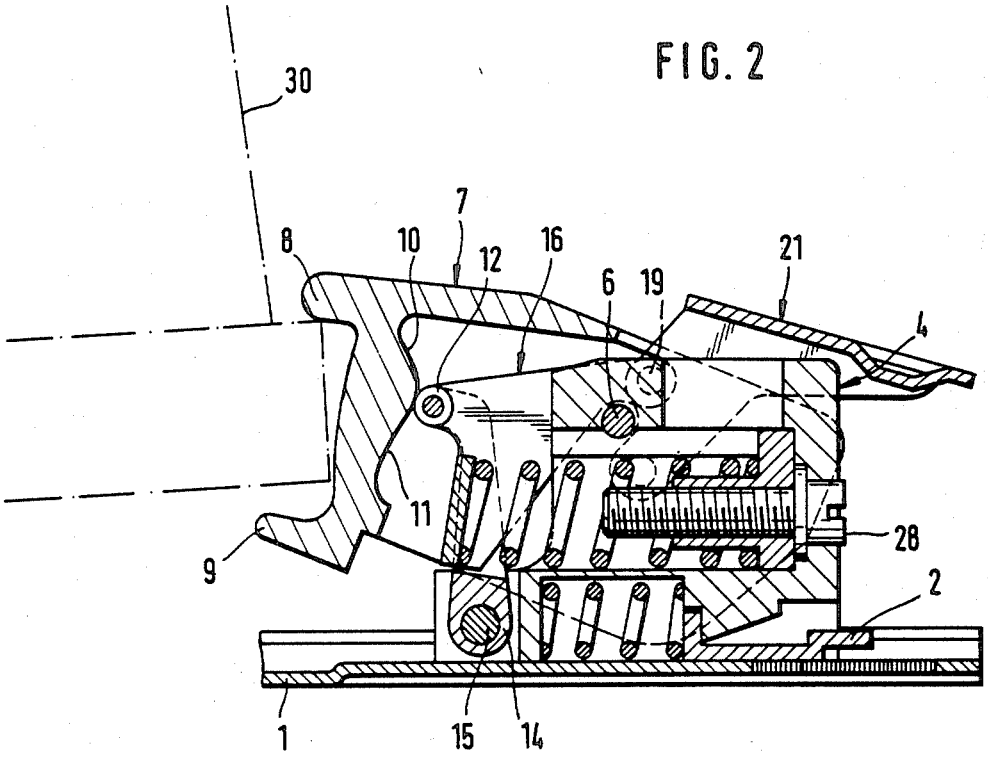
FIG. 2 shows the heel unit of FIG. 1 during safety-release.
Figure 3:
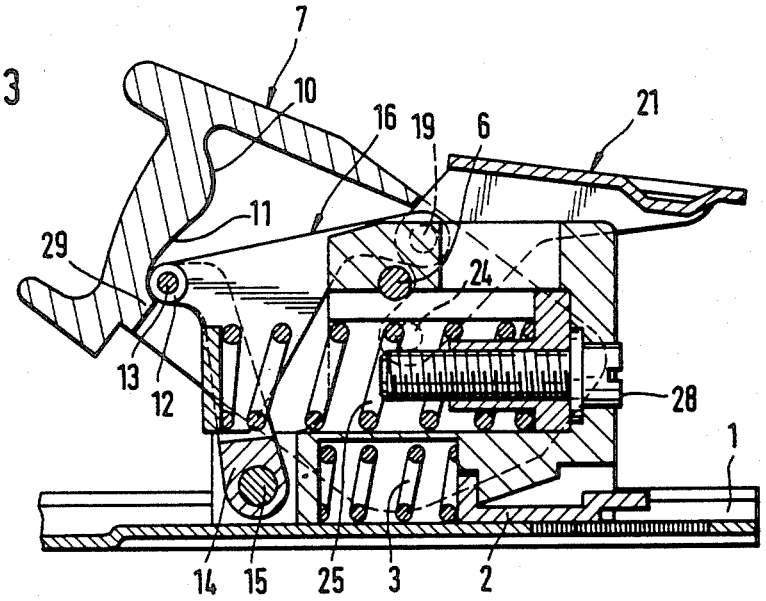
FIG. 3 shows the heel unit of FIGS. 1 and 2 in an open condition.

Referring first to the embodiment of the invention shown in FIGS. 1–3, a heel unit is depicted which comprises a base plate 1, by means of which the unit is mounted on a ski with appropriate fasteners. An abutment member 2 for a spring is mounted such as to be adjustable in the longitudinal direction in the base plate. Abutting the abutment member 2 is a compression spring 3 which acts to bias a slide member 4 which is mounted on the base plate for movement longitudinally of the ski. The heel unit is shown in FIG. 1 in a closed condition, although no ski boot is shown. In this condition, stop portions 5 of slide member 4 abut member 2 from the rearward direction which is to say from the right of the abutment member 2 as shown in the drawing.

The slide member carries a horizontal, transverse bearing pin 6, on which a sole-engaging member or soleholder 7 is pivotally mounted. The sole-engaging member is provided in the usual way with a hold-down portion 8 for pressing down upon the rear edge of the sole of the ski boot, as well as a pedal 9 engagable by the ski boot sole to close the binding. An inner surface of the sole-engaging member is configured to form a first cam means or cam surface comprising an upper concave portion 10 and a lower concave portion 11 which blend one into the other at a critical portion of the cam. A second cam means is a cam follower in the form of a roller 12 which rolls on and cooperates with the cam surface, the roller being mounted for rotation on a bearing pin 13 carried on the free end of a bearing lever 14. Lever 14 is itself pivotally mounted within slide member 4 parallel to soleholder 7 on a transverse pin 15. Lever 14 is substantially U-shaped and has two upwardly extending arms which define a space between them. Between the two arms extends a connecting member 16 in the form of a substantially U-shaped sheet-metal part, having parallel and vertical arms 17 and a transverse bridging portion 18. Owing to the cross-sectional nature of the drawings, only one arm can be seen. Connecting member 16 is pivotally mounted on bearing pin 13 by its arms 17, one on each side of roller 12. Each arm 17 of connecting member 16 is also pivotally connected by way of a pivot pin 19 to a respective one of a pair of arms 20 of a further substantially U-shaped pressed sheet-metal member 21, which comprises the opening lever of the heel unit. A bridging portion 22 of opening lever 21 has an indentation 23 to receive the tip of a ski pole. Each of the pair of arms 20 of opening lever 21 is pivotally connected to soleholder 7 by way of a pivot pin 24.

The bridging portion 18 of connecting member 16 is subject to a biasing force exerted by a coil spring 25 that presses at its rearward end against a flange 26 of an internally threaded spring carrier 27 engaged on a screw 28. This screw is rotatably carried in slide member 4, while spring carrier 27 is non-rotatable but mounted to slide axially in slide member 4. Thus through the turning of the screw, the pre-loading of the coil spring 25 can be altered, thereby correspondingly changing the release loading of the binding heel unit.

At this point it should be particularly noted that coil spring 25, which is responsible for resisting loads tending to release the binding, extends from its abutment adjacent slide member 4 between transverse pins 6 and 15 such that the pivot pin 6 for soleholder 7 is situated above spring 25. Also, connecting member 16 is connected to opening lever 21 by pin 19 above pin 6 and acts at approximately the same height as pin 6 on lever 14. Opening lever 21 is pivotally connected to soleholder 7 about an axis at pin 24 located below and behind pin 6.

The positions of the heel unit components shown in FIG. 1 are effectively those adopted when a ski boot is being held by the binding. Soleholder 7 adjusts itself automatically to the sole thickness of the ski boot through the action of roller 12 on soleholder 7. Roller 12 exerts an appropriate force on the soleholder to retain the sole in place under the influence of spring 25 while roller 12 engages cam portion 10. In the presence of a ski boot, the slide member 4 is forced slightly backwards on the base plate 1, that is to say to the right in the drawing, so that the stop portion 5 is out of contact with the abutment member 2. If the ski boot then exerts an excessively large upwardly directed force on the hold-down portion 8, soleholder 7 swings about transverse pin 6 in a clockwise sense as viewed in the drawings. Correspondingly, roller 12 runs down relative to the cam surface until it reaches the peak or critical portion where the two curve portions 10 and 11 meet, which condition represents the release point of the binding. Up to this point the spring 25 is increasingly loaded as roller 12 proceeds from portion 10 to the critical cam portion. The condition at the release point is shown in FIG. 2. Cam portion 11 is so arranged that soleholder 7 can swing to its open position under the influence of coil spring 25 as transmitted through the roller 12. Thus, once roller 12 passes the critical portion of the cam, spring 25 urges soleholder 7 to its open position as shown in FIG. 3. A nose 29 at the lower end of cam surface portion 11 serves to engage roller 12 to limit upward movement of the soleholder.

A ski boot heel 30 is shown chain-dotted in FIG. 2. With the binding in the open condition of FIG. 3, it can be closed in the usual way by pressing down with the ski boot heel on pedal 9.

Intentional opening of the binding may be achieved through depression of opening lever 21. This may be done with a ski pole, with the second ski or ski boot, or by hand, whichever is preferred. Pivotting of the opening lever acts through connecting member 16 to draw the roller 12 back to compress coil spring 25. This arrangement thus obviates the need for a separate opening spring for the sole-engaging member, and further, enables a compact unit.

Figure 4:
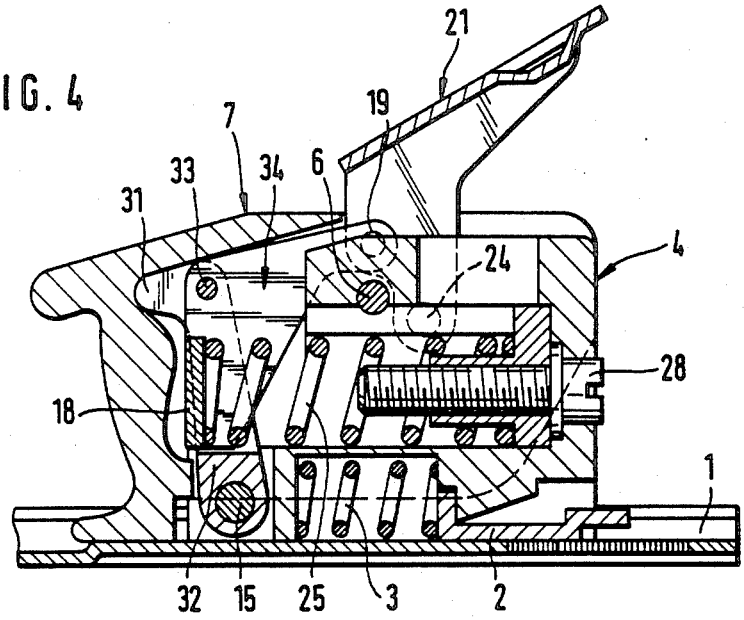
FIGS. 4 and 5 show two further embodiments of the heel unit represented in a similar condition to that of FIG. 1.

The embodiment of heel unit shown in FIG. 4 differs from that of FIGS. 1 to 3 only in that it has a different means restraining soleholder 7. Thus corresponding parts have the same reference numerals. In place of roller 12 a pair of forward projections or nose portions 31 are used that are formed by angling the end of the arms of a lever 32 which, like lever 14 of the first embodiment, is substantially U-shaped. A pivot pin 33 is used to pivotally connect lever 32 with a connecting member 34. Repetition of the description of the mode of operation will be avoided, as this corresponds to that of the previous embodiment.

Figure 5:
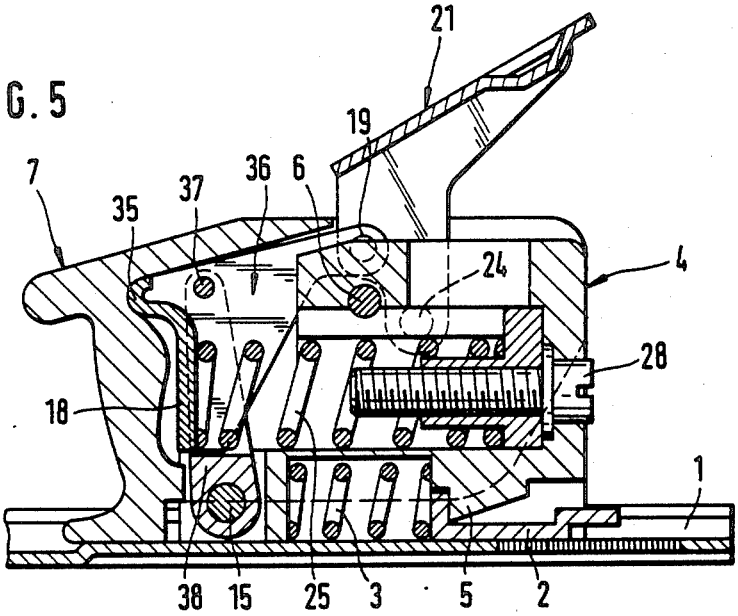

The embodiment of FIG. 5 shows a third possibility for restraining sole-engaging member 7. Here a connecting member 36 with a suitably shaped forward projection or nose 35 is pivotably connected by a pivot pin 37 with a lever 38. The remaining details again correspond with those of the preceding embodiments.

Figure 6:
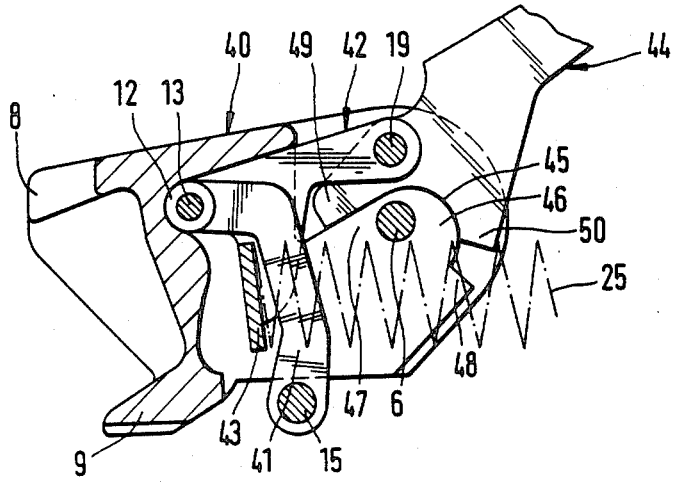
FIG. 6 shows a constructional detail of a further embodiment in cross-sectional side view and in its closed condition.

FIG. 6 shows a constructional detail of a further embodiment of a heel unit according to the invention, in the latched and skiing condition. As with the previous examples, a base-plate-guided slide member is provided which carries the two transverse pins 6 and 15. Again, a soleholder 40 is pivotally carried by transverse pin 6 and a lever 41 by transverse pin 15. At its free end, lever 41 carries the roller 12 mounted on pivot pin 13 which acts in conjunction with the cam surface in the manner described above. A connecting member 42, once again in the form of a bent sheet-metal stamping, is pivotally connected to the lever 41 by pivot pin 13. Coil spring 25 acts on the bridging portion 43 of connecting member 42, the other end of the spring resting, as before, in the slide member which is not illustrated in this Figure.

Connecting member 42 is pivotally connected to opening lever 44 by pivot pin 19. By contrast with the previous embodiments, opening lever 44 is not here mounted on a pivot pin but has a concave bearing surface 45 which abuts an arcuately curved flange 46 of soleholder 40. Flange 46 has at one end a tangentially extending stop portion 47, and at the other end a radially extending stop member 48. Cooperating respective stop portions 49 and 50 are provided on opening lever 44.

Figure 7:
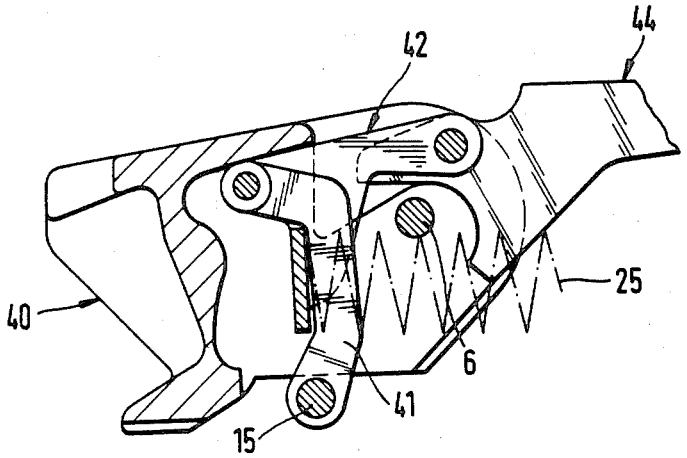
FIG. 7 shows the detail of FIG. 6 but with the operating lever depressed.

Unlike FIG. 6 which shows the unit in position for skiing, FIG. 7 shows opening lever 44 swung so far in its opening direction that stop members 50 and 48 abut one another. Turning of the opening lever results in connecting member 42 being drawn back against the resistance of the coil spring 25. Owing to the eccentric location of concave bearing surface 45 relative to transverse pin 6 of soleholder 40, the latter is already biased towards an open position in the first phase of operation of the opening lever. In the second phase of opening as shown in FIG. 7 the opening lever also achieves a pivotting about the transverse axis of pin 6.

Figure 8:
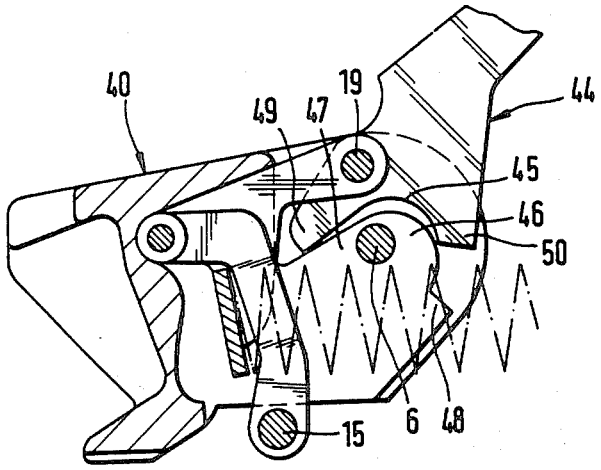
FIG. 8 shows the detail of FIG. 6 immediately before the end of the closing movement of the sole-engaging member.

Finally, FIG. 8 shows the arrangement at the moment soleholder 40 reaches its closed position. A damping of the closing movement, that is to say the avoidance of an abrupt halt to the movement, is achieved in that opening lever 44 swings up around stop portion 49 under the influence of kinetic energy, whereby connecting member 42 turns about the pivot pin 13 against the force of the coil spring 25. With the subsequent unloading of the spring, the components adopt their respective positions as shown in FIG. 6.

The invention in its preferred forms can be seen to achieve the objects of the invention. An improved heel piece for a ski binding has been provided which is simple in construction and thus economical to manufacture. The binding provides for manual release without need for a special spring for use in conjunction with the opening lever. Boot soles of various thicknesses can be accommodated without any special adjustments. The binding heelpiece is compact and rugged, and effective and efficient in operation.

The invention has been described in detail with emphasis on its preferred embodiments, but it should be understood that variations and modifications within the spirit and scope of the invention may occur to those skilled in the art to which the invention pertains.

We claim:

1. A heelpiece for a safety ski binding, said heelpiece comprising:

a base for attachment to a ski;

a support member mounted on said base;

a soleholder mounted on said support member for pivotal movement about a first axis transverse to said support member between closed and open positions for holding and releasing a ski boot, respectively, said soleholder having a forwardly extending ski boot engaging member and including a rearward facing flange surface on the rear end thereof;

a bearing lever mounted on said support member for pivotal movement about a second axis, said second axis being fixedly located near said base and parallel to said first axis;

opening lever means having a surface in operative engagement with the flange surface of said soleholder for movement therealong to effect arcuate movement of said opening lever means about an imaginary third axis, said third axis being parallel to and offset from said first axis;

connecting means connected to said opening lever means and to said bearing lever, said connecting means being attached to said opening lever means for rotation about a fourth axis parallel to said first, second and third axes;

said soleholder having first cam means and said bearing lever having second cam means, said first cam means having a first portion, a second portion and a critical portion between said first and second portions, and said second cam means being engageable with the respective portions of said first cam means; and, adjustable spring means for biasing said second cam means against said first cam means;

said second cam means engaging the first portion of said first cam means and said spring means biasing said soleholder to the closed position when said second cam means proceeds from said critical portion towards said first portion, and said second cam means engaging the second portion of said first cam means and said spring means biasing said soleholder to the open position when said second cam means proceeds from said critical portion towards said second portion.

2. The invention according to claim 1 wherein said fourth axis is located above said first axis.

3. The invention according to claim 1 wherein said third axis is adjacent said first axis.

4. The invention according to claim 1 wherein said third axis is below and rearward of said first axis.

5. The invention according to claim 1 wherein said connecting means comprises a connecting lever pivotally attached to said bearing lever and to said opening lever means, said connecting lever including parallel, vertical opposing side walls connected by a bridging member, and said spring means being located between said side walls and in engagement with said bridging member.

6. The invention according to claim 1 wherein said soleholder flange surface includes a curved bearing surface and said opening lever means surface includes a concave bearing surface engageable with said curved bearing surface for pivotal movement about said third axis.

7. The invention according to claim 6 and further including stop means for limiting the range of pivotal movement of said opening lever means.

* * * * *